US009623294B1

(12) United States Patent
Kingston et al.

(10) Patent No.: US 9,623,294 B1
(45) Date of Patent: Apr. 18, 2017

(54) GOLF CLUB HEAD WITH ADJUSTABLE WEIGHTING

(71) Applicant: CALLAWAY GOLF COMPANY, Carlsbad, CA (US)

(72) Inventors: Keith L. Kingston, Carlsbad, CA (US); Matthew Myers, Carlsbad, CA (US); Wee Joung Kim, Vista, CA (US)

(73) Assignee: Callaway Golf Company, Carlsbad, CA (US)

( * ) Notice: Subject to any disclaimer, the term of this patent is extended or adjusted under 35 U.S.C. 154(b) by 35 days.

(21) Appl. No.: 14/933,973

(22) Filed: Nov. 5, 2015

Related U.S. Application Data

(63) Continuation-in-part of application No. 14/163,946, filed on Jan. 24, 2014, now Pat. No. 9,211,453, and a continuation-in-part of application No. 14/174,068, filed on Feb. 6, 2014, now Pat. No. 9,289,660.

(51) Int. Cl.
*A63B 53/04* (2015.01)
*A63B 53/06* (2015.01)

(52) U.S. Cl.
CPC .. *A63B 53/0466* (2013.01); *A63B 2053/0491* (2013.01)

(58) Field of Classification Search
USPC ..... 473/324–350
See application file for complete search history.

(56) References Cited

U.S. PATENT DOCUMENTS 2,098,445 A * 11/1937 Wettlaufer ..... A63B 53/04 473/333
2,155,830 A * 4/1939 Howard ..... A63B 53/06 473/246
2,171,383 A * 8/1939 Wettlaufer ..... A63B 53/08 473/335
2,652,256 A * 9/1953 Thomas ..... A63B 53/08 473/333
3,136,546 A * 6/1964 Connolly ..... A63B 15/005 446/421
3,199,874 A * 8/1965 Blasing ..... A63B 49/00 473/244

(Continued)

FOREIGN PATENT DOCUMENTS

JP 01043278 A * 2/1989
JP 2005296582 A * 10/2005

(Continued)

*Primary Examiner* — Alvin Hunter
(74) *Attorney, Agent, or Firm* — Rebecca Hanovice; Michael Catania; Sonia Lari

(57) ABSTRACT

A golf club head comprising a means for adjusting the location of the center of gravity is disclosed herein. In particular, the golf club head of the present invention comprises a first channel that includes a rail extending upwards from its floor and a second channel including a groove extending into its floor. The second channel intersects the first channel at a junction, and a slidable weight comprising a contoured body portion, one or more mechanical fasteners, and a clamping structure that engages the rail or the groove when the one or more fasteners are tightened is disposed within at least one of the channels. The slidable weight can be moved into either of the channels without being removed from the golf club head and indexed, thus saving a golfer time during adjustment.

17 Claims, 11 Drawing Sheets

(56) References Cited

U.S. PATENT DOCUMENTS 3,220,733 A * 11/1965 Saleeby ..... A63B 53/0487 473/335
5,230,509 A * 7/1993 Chavez ..... A63B 53/0487 473/334
5,683,309 A * 11/1997 Reimers ..... A63B 53/04 473/337
5,709,611 A * 1/1998 Intag ..... A63B 69/3685 473/236
5,916,042 A * 6/1999 Reimers ..... A63B 53/04 473/334
6,015,354 A * 1/2000 Ahn ..... A63B 53/04 473/256
6,277,032 B1 * 8/2001 Smith ..... A63B 53/04 473/336
6,386,987 B1 * 5/2002 Lejeune, Jr. ..... A63B 53/04 473/219
6,821,212 B2 * 11/2004 Fowler ..... A63B 69/3632 473/236
6,890,267 B2 * 5/2005 Mahaffey ..... A63B 53/0466 473/256
7,108,609 B2 * 9/2006 Stites ..... A63B 53/06 473/256
7,128,662 B2 * 10/2006 Kumamoto ..... A63B 53/0466 473/345
7,147,573 B2 12/2006 DiMarco
7,166,041 B2 * 1/2007 Evans ..... A63B 53/0466 473/334
7,452,286 B2 * 11/2008 Lin ..... A63B 53/0466 473/334
7,611,424 B2 * 11/2009 Nagai ..... A63B 53/0466 473/334
7,704,163 B2 * 4/2010 Stites ..... A63B 53/047 473/334
7,775,905 B2 * 8/2010 Beach ..... A63B 53/0466 473/256
7,806,782 B2 * 10/2010 Stites ..... A63B 53/0466 473/334
7,824,280 B2 * 11/2010 Yokota ..... A63B 53/0466 473/334
8,016,694 B2 * 9/2011 Llewellyn ..... A63B 53/0466 473/334
8,057,323 B2 * 11/2011 Liang ..... A63B 53/0487 473/334
8,192,303 B2 * 6/2012 Ban ..... A63B 53/0466 473/335
8,202,175 B2 * 6/2012 Ban ..... A63B 53/0466 473/334
8,262,495 B2 * 9/2012 Stites ..... A63B 53/047 473/226
8,608,588 B2 * 12/2013 Horii ..... A63B 53/0487 473/334
8,696,491 B1 * 4/2014 Myers ..... A63B 53/06 473/334
8,747,253 B2 * 6/2014 Stites ..... A63B 53/0466 473/334
8,790,195 B1 * 7/2014 Myers ..... A63B 53/0466 473/335
8,821,307 B2 * 9/2014 Park ..... A63B 53/04 473/244
8,870,678 B2 * 10/2014 Beach ..... A63B 53/0466 473/334
8,894,506 B1 * 11/2014 Myers ..... A63B 53/0466 473/334
8,968,116 B1 * 3/2015 Myers ..... A63B 53/0466 473/334
9,033,813 B2 * 5/2015 Oldknow ..... A63B 53/0466 473/244
9,101,811 B1 * 8/2015 Goudarzi ..... A63B 53/0466
9,199,145 B1 * 12/2015 Myers ..... A63B 53/06
9,211,453 B1 * 12/2015 Foster ..... A63B 53/06
9,233,282 B2 * 1/2016 Stites ..... A63B 53/06
9,259,627 B1 * 2/2016 Myers ..... A63B 53/04
9,320,950 B2 * 4/2016 Matsunaga ..... A63B 53/06
9,364,728 B1 * 6/2016 Myers ..... A63B 53/06
9,387,376 B1 * 7/2016 Hall ..... A63B 53/06
9,415,280 B2 * 8/2016 Stokke ..... A63B 53/0466
2006/0058112 A1 * 3/2006 Haralason ..... A63B 53/0466 473/334
2006/0122004 A1 * 6/2006 Chen ..... A63B 53/0466 473/335
2006/0178228 A1 * 8/2006 DiMarco ..... A63B 53/0466 473/334
2006/0240907 A1 * 10/2006 Latiri ..... A63B 53/0466 473/334
2006/0240908 A1 * 10/2006 Adams ..... A63B 53/0466 473/334
2008/0020861 A1 * 1/2008 Adams ..... A63B 53/04 473/334
2008/0261715 A1 * 10/2008 Carter ..... A63B 53/0466 473/291
2010/0075773 A1 * 3/2010 Casati, Jr. ..... A63B 49/02 473/334
2010/0292027 A1 11/2010 Beach et al.
2011/0053705 A1 * 3/2011 Stites ..... A63B 53/0466 473/334
2015/0321055 A1 * 11/2015 Golden ..... A63B 53/0466 473/338

FOREIGN PATENT DOCUMENTS

JP 2005323978 A * 11/2005
JP 2006-320493 11/2006
JP 2006320493 A * 11/2006
JP 2008086337 A * 4/2008
JP 2010252964 A * 11/2010
JP 2011010722 A * 1/2011
JP 2014111170 A * 6/2014
WO WO 2007044220 A1 * 4/2007 ..... A63B 53/06

* cited by examiner

GOLF CLUB HEAD WITH ADJUSTABLE WEIGHTING

CROSS REFERENCES TO RELATED APPLICATIONS

The present application is a continuation-in-part of U.S. patent application Ser. No. 14/163,946, filed on Jan. 24, 2014, and is also a continuation-in-part of U.S. patent application Ser. No. 14/174,068, filed on Feb. 6, 2014, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a slidable weight for a golf club head that can be adjusted along one or more channels in the golf club head.

Description of the Related Art

The ability to adjust center of gravity location and weight in a golf club head is useful for controlling performance of the golf club. The prior art includes several different solutions for adjustable weighting, but these solutions do not optimize weight adjustment, especially along tracks or channels that follow the curvature of the golf club head or intersect with other channels. For example, several golf club manufacturers employ multiple piece slidable weights that clamp a pair of rails in a channel when the weights are fixed in place, but these designs are more complex and costly than they need to be, and the numerous pieces associated with the weights increases the likelihood that parts will get lost during adjustment. The presence of multiple rails also increases the overall weight of the golf club head and reduces the amount of discretionary mass available to the manufacturer during the design process. Therefore, there is a need for a weighting mechanism that allows for simple and flexible center of gravity (CG) and moment of inertia (MOI) adjustability along channels that follow a golf club head's curvature.

BRIEF SUMMARY OF THE INVENTION

The present invention allows consumers to easily move and fix a weight at any location within intersecting channels disposed in the golf club head in such a way to maximize aesthetic appearances while preserving the function of the movable weight. The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

The slidable weight of the present invention fits within a contoured or rounded track and can be clamped to any location along the track. The slidable weight is added to the track at a single location, and, when engaged with the track, the slidable weight has multiple points of contact at each location on the track despite the changing contour and track geometry. The slidable weight may also include two different dovetail designs with opposing male/female engagements that allow the weight to travel along tracks going in different directions via one or more intersection points.

One aspect of the present invention is a golf club head comprising a body comprising a face and a sole, a crown, at least one rail, and a first weight assembly comprising at least one mechanical fastener comprising a head portion and a threaded extension portion, and a body portion comprising an upper surface, a lower surface, at least one threaded through bore extending from the upper surface to the lower surface, and a clamping portion extending from the lower surface, wherein the sole comprises a first channel comprising a first floor, wherein the rail is disposed within the first channel and extends from the first floor in a direction normal to the first floor, wherein the body portion receives at least an upper portion of the at least one rail within the clamping portion, wherein the threaded extension portion is sized to fit within the threaded through bore, and wherein the first weight assembly is reversibly affixed to the at least one rail with the mechanical fastener.

In some embodiments, the clamping portion may comprise first and second tapered projections, and each of the first and second tapered projections may increase in length as it extends away from the lower surface of the body portion. In a further embodiment, a cross-section of the upper portion of the at least one rail may be V-shaped, a cross-section of a void between the first and second tapered projections may be V-shaped, and the void may be sized to receive the upper portion of the at least one rail. In a further embodiment, the first and second tapered projections may have a first plurality of surface radii, the at least one rail may have a second plurality of surface radii, and the first plurality of surface radii may be smaller than the second plurality of surface radii. In another embodiment, the threaded extension portion may abut an upper surface of the at least one rail when the at least one mechanical fastener is fully engaged with the threaded through bore.

In some embodiments, the golf club head may further comprise a second channel comprising a second channel length and a second floor, the second floor may comprise a groove, the groove may extend along the entire second channel length, and the groove may be shaped to receive the clamping portion of the first weight. In a further embodiment, the clamping portion may comprise first and second tapered projections, each of the first and second tapered projections may increase in length as it extends away from the lower surface of the body portion, the groove may comprise a groove floor and first and second groove sidewalls, and the first and second groove sidewalls may extend towards one another as they extend away from the groove floor. In another embodiment, the second channel may intersect with the first channel, and may extend in a direction normal to at least a portion of the first channel.

In some embodiments, the body portion of the first weight assembly may have contoured shape, the at least one threaded through bore may comprise a first threaded through bore and a second threaded through bore, and the at least one mechanical fastener may comprise a first bolt and a second bolt. In a further embodiment, the body portion may have an elliptical shape. In another embodiment, the first weight assembly may have at least four points of contact on the at least one rail when the first and second bolts are fully engaged with the threaded through bore. In some embodiments, the at least one rail may comprise a first rail and a second rail, the clamping portion may have a first length, an open space may be disposed between the first rail and the second rail, and the open space may have a second length that is greater than the first length.

In a further embodiment, the golf club head may further comprise a second channel comprising a second floor, the second floor may comprise a groove, the groove may be shaped to receive the clamping portion of the first weight, the clamping portion may be inserted into the groove at a groove opening, the second channel may intersect with the first channel, and the groove opening may be disposed proximate the open space between the first and second rails. In another embodiment, the golf club head may further comprise a plug sized to fit within the open space and prevent the first weight from disengaging from either of the first and second rails.

Another aspect of the present invention is a wood-type golf club head comprising a face component, and a sole comprising a heel side, a toe side, a rear side, a first channel extending from the heel side to the toe side via the rear side, and a second channel extending from a location proximate the face to the rear side and intersecting the first channel at the rear side, a crown, a weight assembly comprising first and second bolts and an elliptical body portion comprising an upper surface, a lower surface, first and second threaded through bores extending from the upper surface to the lower surface, and a clamping portion extending from the lower surface, wherein the first bolt is engaged with the first threaded through bore, wherein the second bolt is engaged with the second threaded through bore, wherein the clamping portion comprises first and second projections, wherein the clamping portion is disposed between the first and second threaded through bores, wherein the first channel comprises a first floor and a rail extending upwards from the first floor, wherein the second channel comprises second floor and a groove sized to receive the clamping portion disposed in the second floor, wherein a void between the first and second projections is sized to receive at least a portion of the rail, wherein when a portion of the rail is disposed within the void, tightening at least one of the first and second bolts reversibly fixes the weight assembly within the first channel, and wherein when the clamping portion is disposed within the groove, tightening at least one of the first and second bolts reversibly fixes the weight assembly within the second channel.

In some embodiments, when the weight assembly is disposed within the first channel, the weight assembly may have at least four points of contact with the rail when the first and second bolts are tightened within the first and second threaded through bores. In another embodiment, when the weight assembly is disposed within the second channel, the first and second bolts may contact the second floor when the first and second bolts are tightened within the first and second threaded through bores. In yet another embodiment, the rail may have a cross-sectional shape selected from the group consisting of T-shaped, V-shaped, and Y-shaped. In another embodiment, the first and second projections may comprise wall radii that are smaller than any wall radii on the rail.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. The embodiments may also work in conjunction with at least one adjustable weight port on the sole, crown, and/or other part of the driver head. Shifting weight along the channel described herein gives a user control of the golf club head's center of gravity location and other mass properties.

Figure 1:
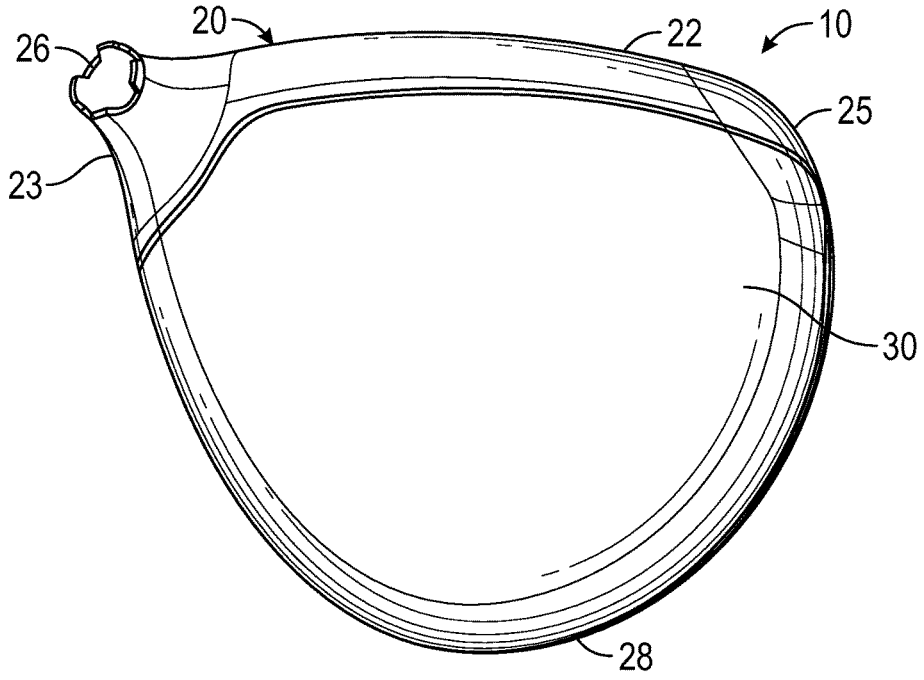
FIG. 1 is a top plan view of a first embodiment of the golf club of the present invention.
Figure 2:
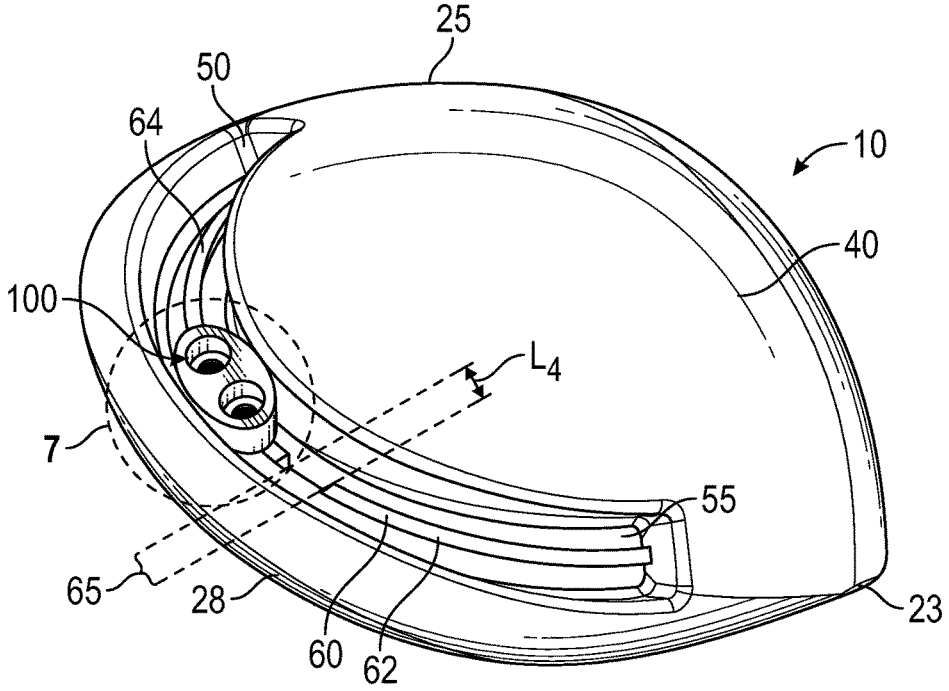
FIG. 2 is a bottom perspective view of the embodiment shown in FIG. 1.
Figure 3:
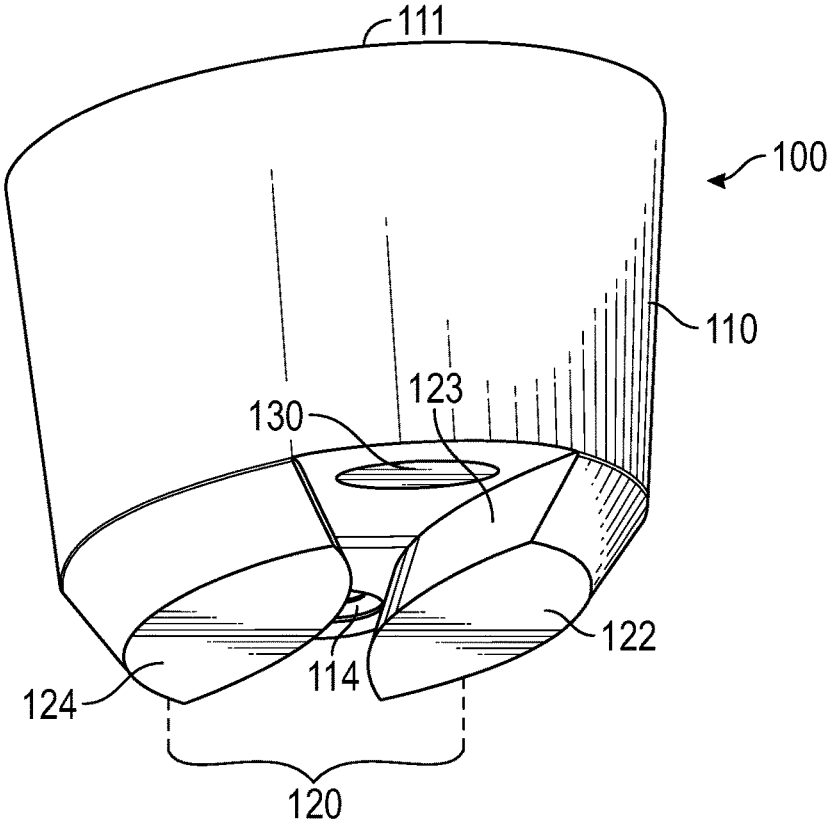
FIG. 3 is an elevational view of the slidable weight shown in FIG. 2 with a bolt engaged with one threaded bore.
Figure 4:
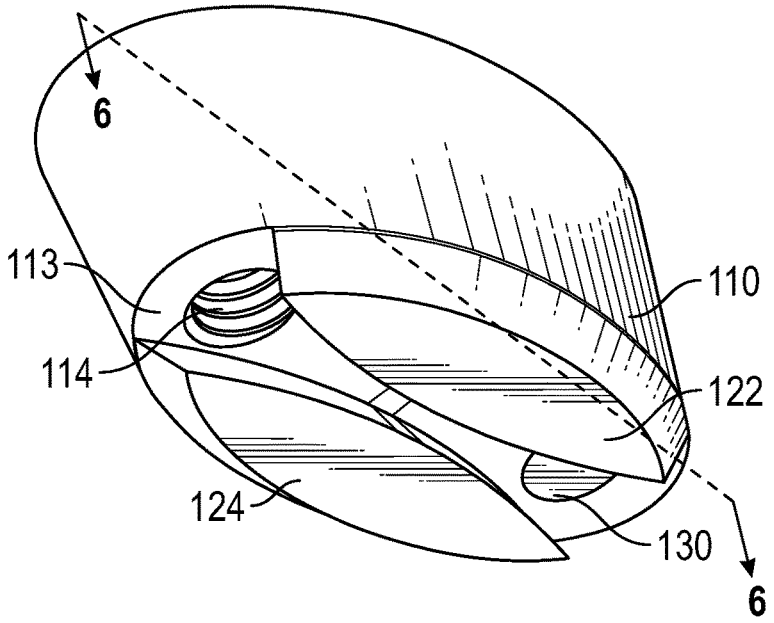
FIG. 4 is a sole perspective view of the slidable weight shown in FIG. 3.

A first embodiment of the present invention is shown in FIGS. 1-10. The golf club head 10 comprises a body 20 composed of a metal material and a crown 30 composed of a composite material covering an upper opening (not shown) in the body 20. The body 20 includes a face 22, a heel side 23, a toe side 25, a hosel 26, a rear side 28, and a sole 40, and preferably is integrally cast from a titanium or steel alloy. As shown in FIG. 2, the sole 40 includes an elongated channel 50 that extends from the heel side 23 to the toe side 25 via the rear side 28 and receives a slidable weight assembly 100 on a rail 60 extending upwards from a floor 55 of the elongated channel 50. The rail 60 has two segments 62, 64 separated by an open space 65 where the weight assembly 100 can be inserted into the elongated channel 50 and onto one of the rail 60 segments 62, 64. The rail 60 preferably is integrally cast, molded, forged, or formed with the body 20, but in an alternative embodiment may be separately created and assembled as disclosed in U.S. patent application Ser. No. 14/174,068, the disclosure of which is hereby incorporated by reference in its entirety herein.

Figure 5:
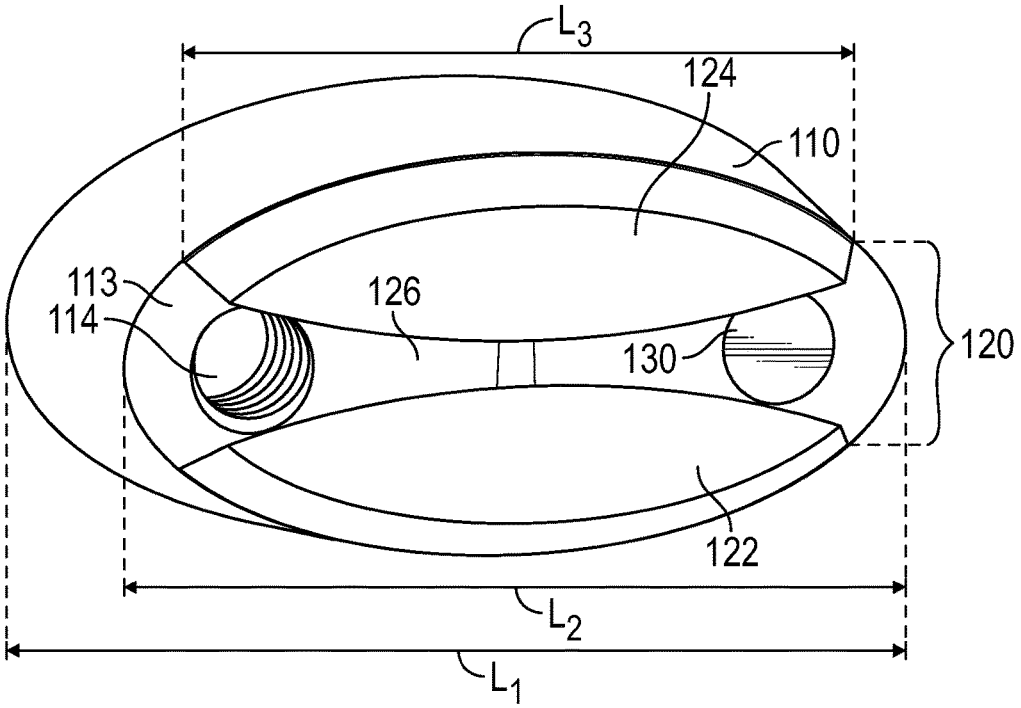
FIG. 5 is a sole plan view of the slidable weight shown in FIG. 3.
Figure 6:
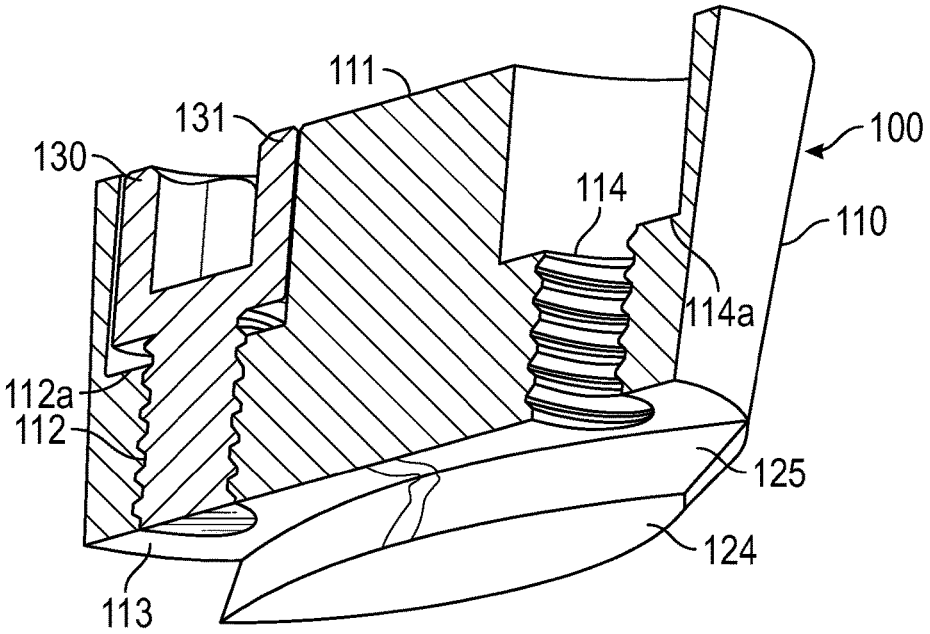
FIG. 6 is a cross-sectional view of the slidable weight shown in FIG. 4 along lines 6-6.

The weight assembly 100 includes a contoured body portion 110, which preferably has an elliptical shape as shown in FIGS. 2 and 4-6 (but may, in the alternative embodiment shown in FIGS. 11 and 12, have a smaller, circular shape), and a pair of bolts 130, 135 extending through two threaded through-bores 112, 114 in the body portion 110. The body portion 110 includes an upper surface 111 that tapers to a lower surface 113, such that the body portion 110 has a first length $L_1$ and a second length $L_2$, and a clamping portion 120 comprising a pair of tapered projections 122, 124 extending from the lower surface 113. As shown in FIG. 5, the tapered projections 122, 124 in this embodiment each have a third length $L_3$ that is only slightly shorter in length than the second length $L_2$, such that the void 126 between the tapered projections 122, 124 functions as a channel that receives at least an upper portion 67 of the rail 60. The open space 65 between the rail 60 segments 62, 64 has a length $L_4$ that is slightly longer than the third length $L_3$ so that the body portion 110 has enough room to be placed within the elongated channel 50 in such a way that it can be slid onto the rail 60.

Figure 7:
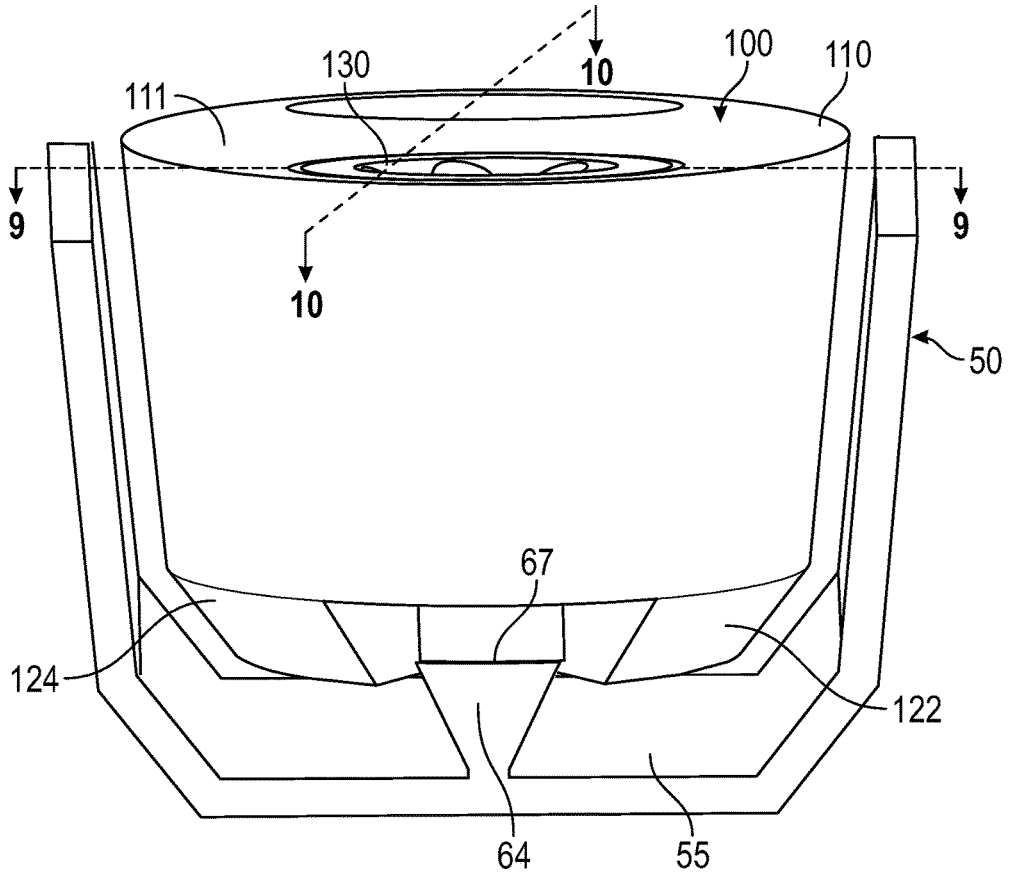
FIG. 7 is a magnified, side elevational view of the circled area in FIG. 2.
Figure 8:
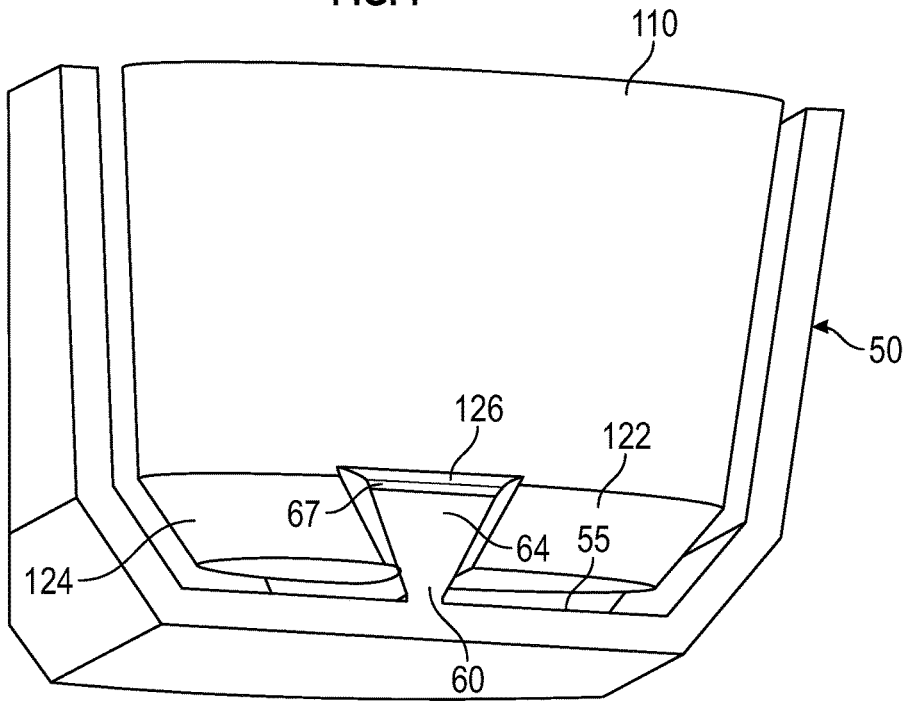
FIG. 8 is another side elevational view of the embodiment shown in FIG. 7.
Figure 9:
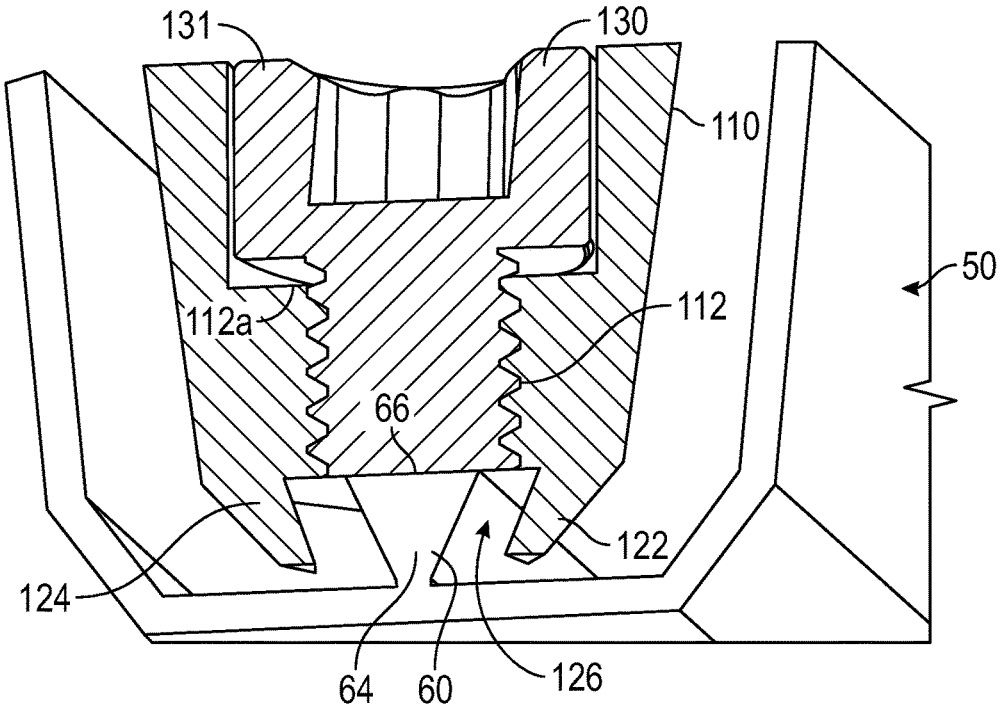
FIG. 9 is a cross-sectional view of the embodiment shown in FIG. 7 along lines 9-9.
Figure 10:
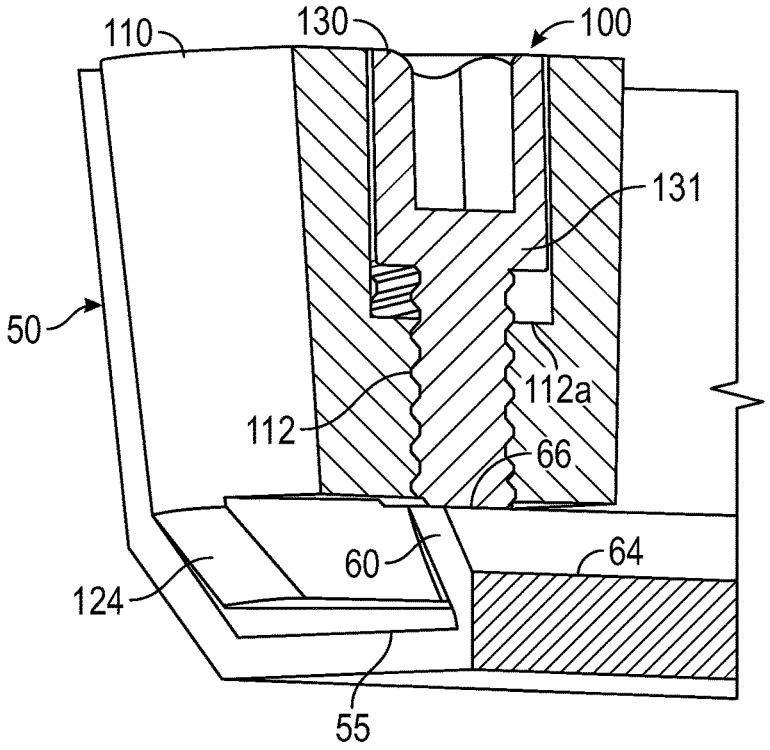
FIG. 10 is a cross-sectional view of the embodiment shown in FIG. 7 along lines 10-10.

The rail 60 in the embodiments disclosed herein has a V-shaped cross-section, but in alternative embodiments may have Y- or T-shaped cross-sections. As shown in FIGS. 7-9 the void 126 in the clamping portion 120 has a similar geometry, which allows for a smaller clamping face between the body portion 110 and the rail 60. After the body portion 110 is inserted onto the rail 60, the weight assembly 100 can move freely within the elongated channel 50 and be clamped at any position on the rail 60 except for the open space 65 between the rail 60 segments 62, 64. As shown in FIG. 8, when the bolts 130, 135 are tightened within the threaded through-bores 112, 114, the bolts 130, 135 press down on an upper surface 66 of the rail 60, creating a clamping force between lower sides of the V-shaped rail 60 and the inner surfaces 123, 125 of the tapered projections 122, 124. In this way, the weight assembly 100 is reversibly fixed to the rail 60 within the elongated channel 50 and will not be dislodged when the golf club head 10 is in use. The curvature of the tapered projections' 122, 124 inner surfaces 123, 125 allows the weight assembly 100 to move freely, as they have smaller radii than that of the rail's 60 radii.

Figure 11:
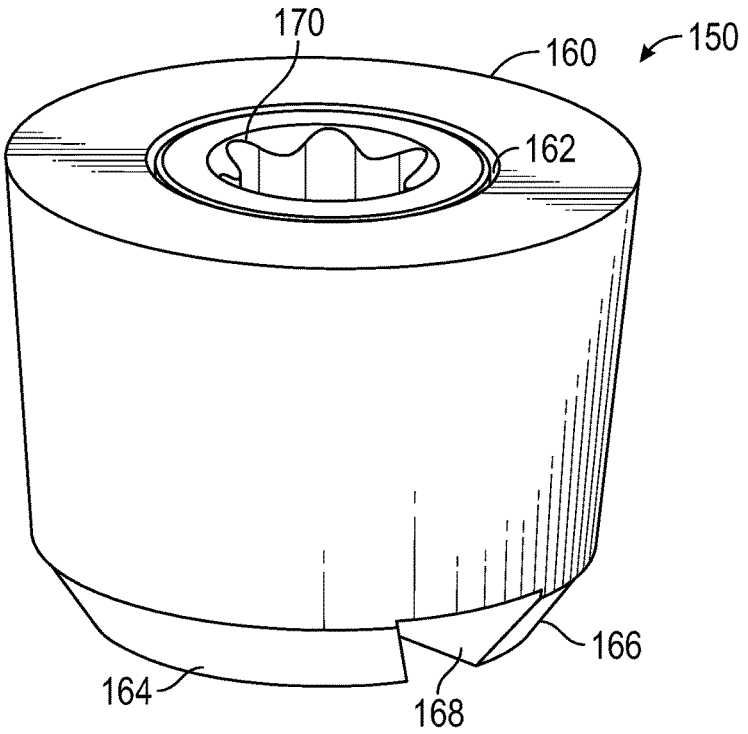
FIG. 11 is an alternative embodiment of a slidable weight for use with the embodiment shown in FIG. 2.
Figure 12:
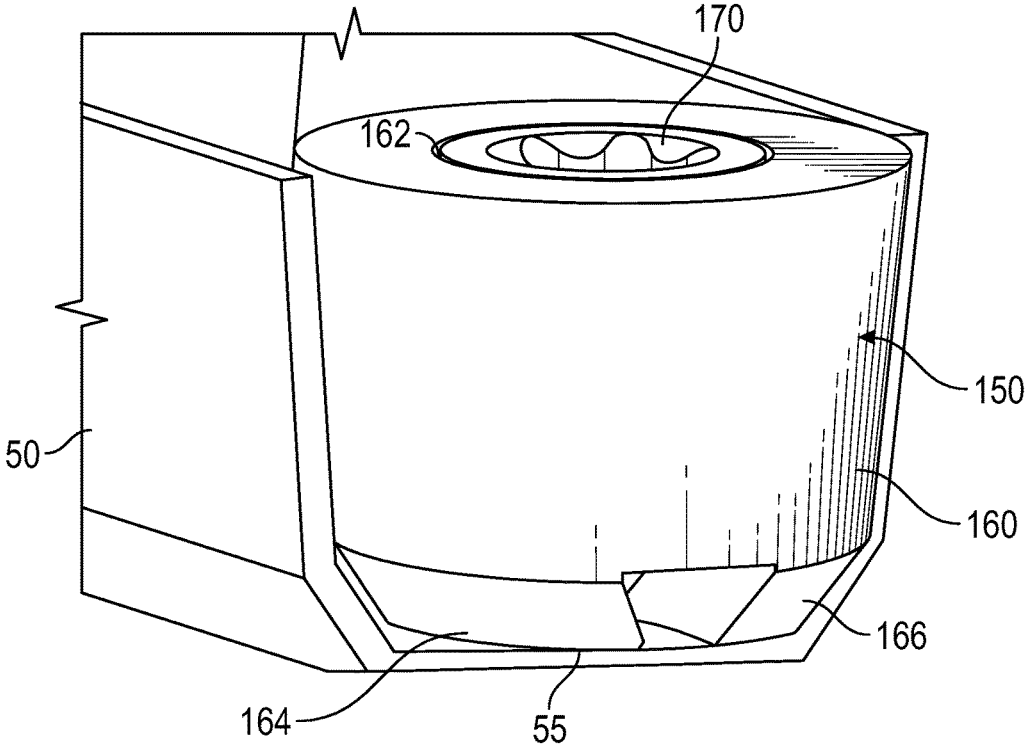
FIG. 12 is a side perspective view of the slidable weight shown in FIG. 11 engaged with the channel of the embodiment shown in FIG. 2.

FIGS. 11 and 12 illustrate an alternative embodiment of the weight assembly 150 for use with the first embodiment. In this embodiment, the weight assembly 150 comprises a body portion 160 with a single threaded through bore 162 and a single bolt 170 and a pair of tapered projections 164, 166 with a void 168 between them sized to receive the rail 60 disclosed herein. This weight assembly 150 functions in the same way as the weight assembly 100 disclosed in connection with FIGS. 1-10.

A preferred embodiment of the present invention is illustrated in FIGS. 13-23. In this embodiment, the golf club head 10 has all of the same features as that of the first embodiment, except that the sole 40 includes two elongated channels 50, 70 that intersect with one another proximate the rear side 28 of the body 20. The first elongated channel 50 curves at it extends around the rear side 28 of the body 20, while the second elongated channel 70 is linear, extends approximately normal to the face 22 in a front-to-back direction, and intersects with the first elongated channel 50 at a junction 90 located at an approximate midpoint 52 of the first elongated channel 50. The second elongated channel 70 is slightly shallower than the first elongated channel 50, such that the floor 75 of the second elongated channel 70 is elevated in comparison with the floor 55 of the first elongated channel 50 and level with the upper surface 66 of the rail 60, but the second elongated channel 70 also includes a groove 80 extending along its entire length with a lower surface 82 that is flush with the floor 55 of the first elongated channel 50.

Figure 13:
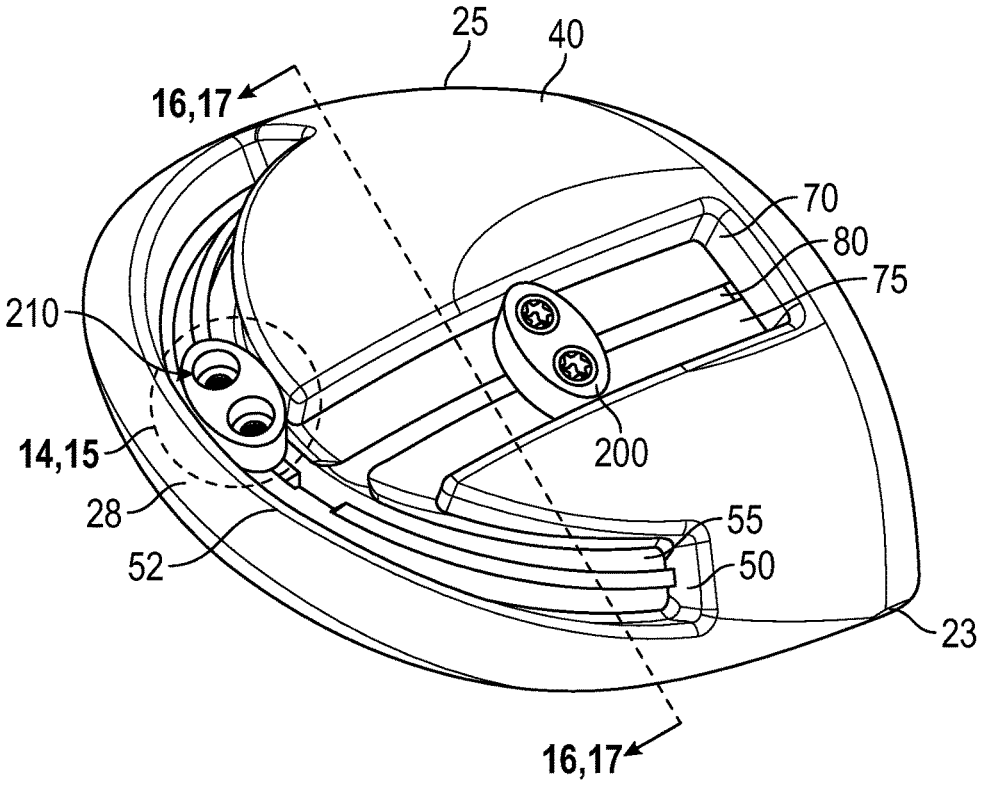
FIG. 13 is a bottom perspective view of a second embodiment of the golf club of the present invention.
Figure 14:
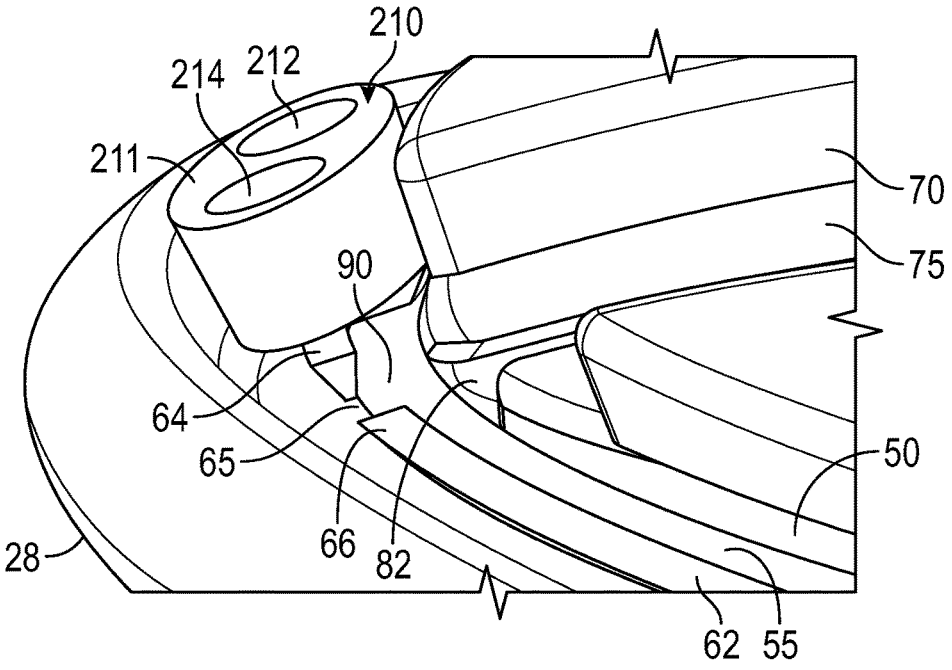
FIG. 14 is a magnified, side perspective view of the circled area in FIG. 13.
Figure 15:
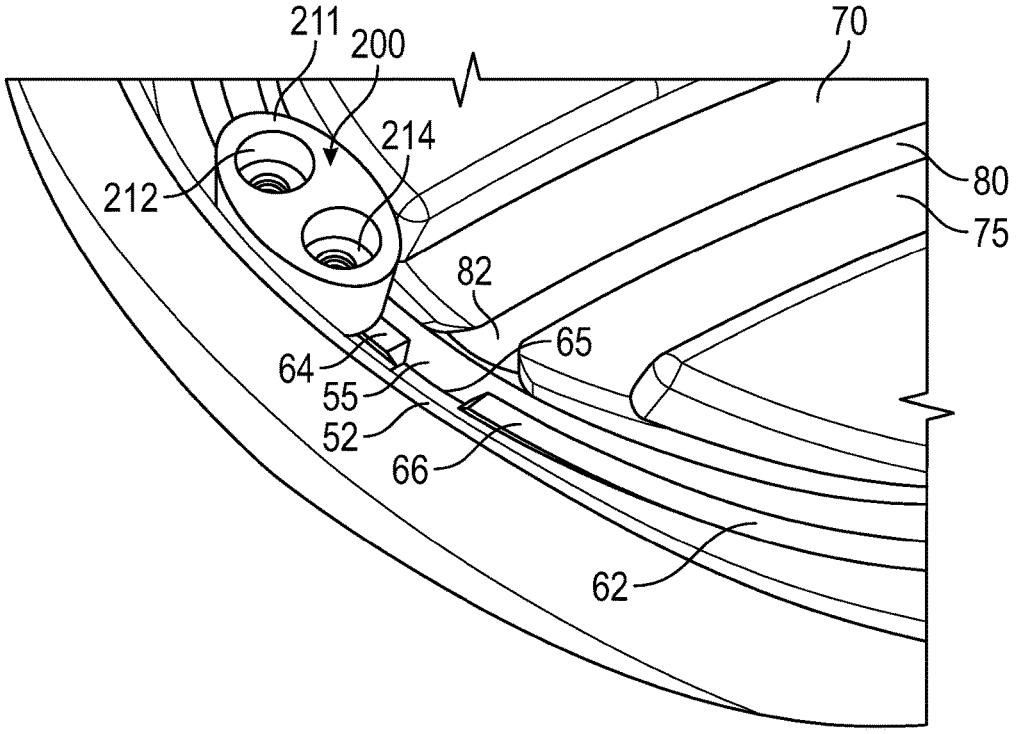
FIG. 15 is a magnified view of the circled area in FIG. 13.
Figure 16:
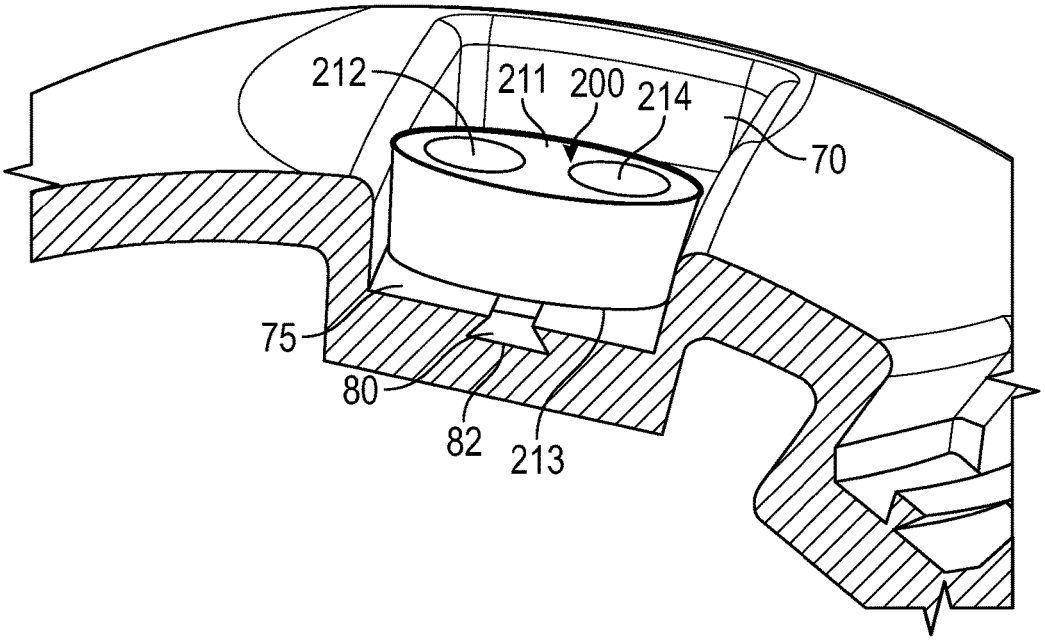
FIG. 16 is a cross-sectional view of the embodiment shown in FIG. 13 along lines 16-16 without bolts engaged with the slidable weight.
Figure 17:
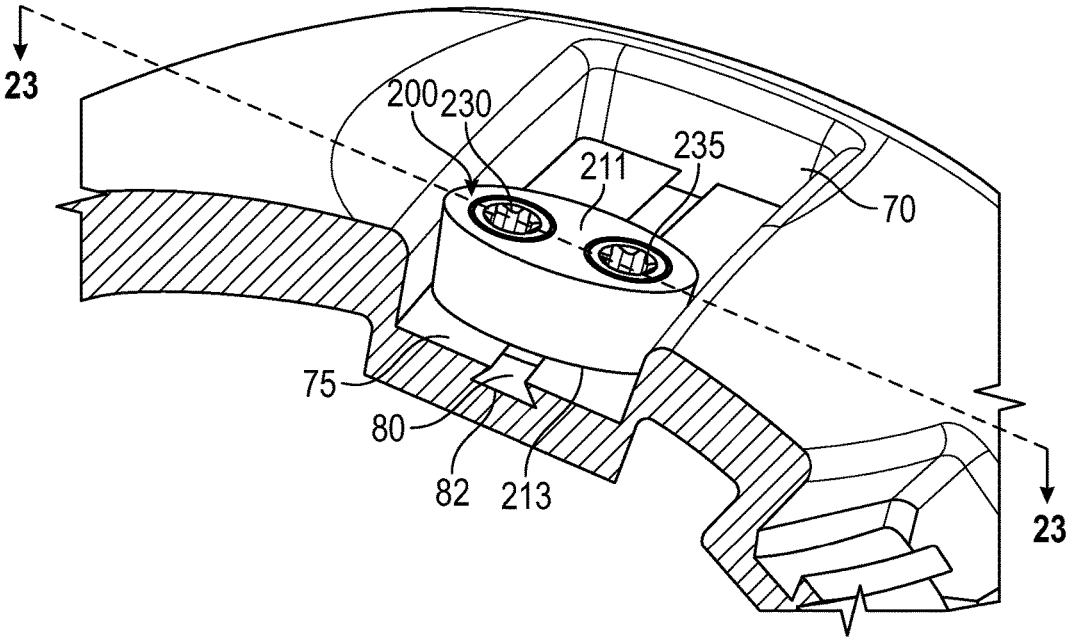
FIG. 17 is a cross-sectional view of the embodiment shown in FIG. 13 along lines 17-17.
Figure 18:
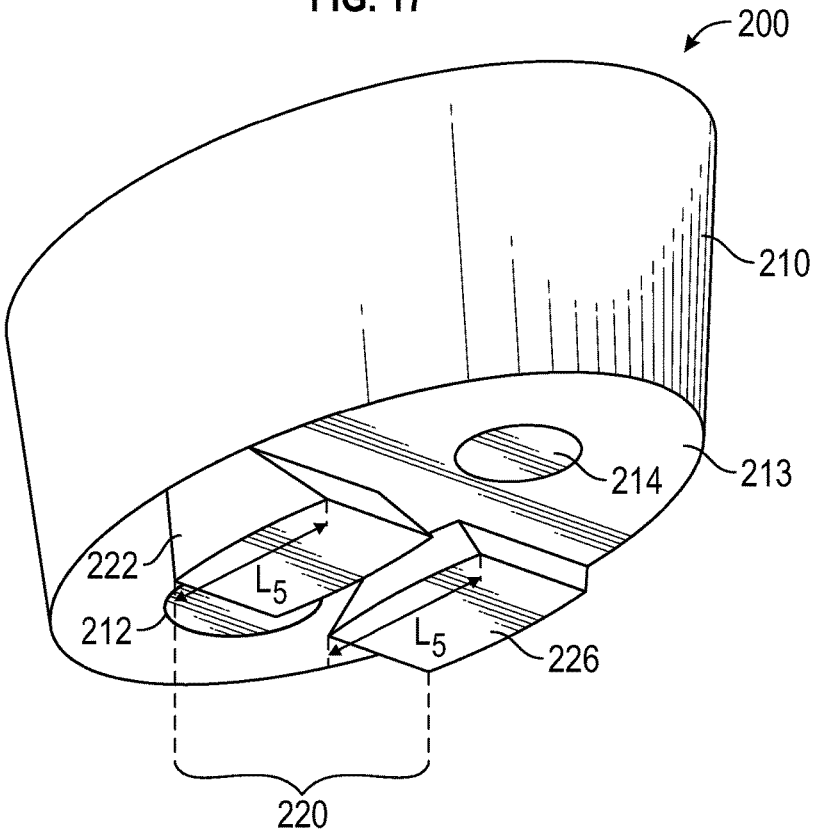
FIG. 18 is a bottom perspective view of one of the slidable weights shown in FIG. 13.
Figure 19:
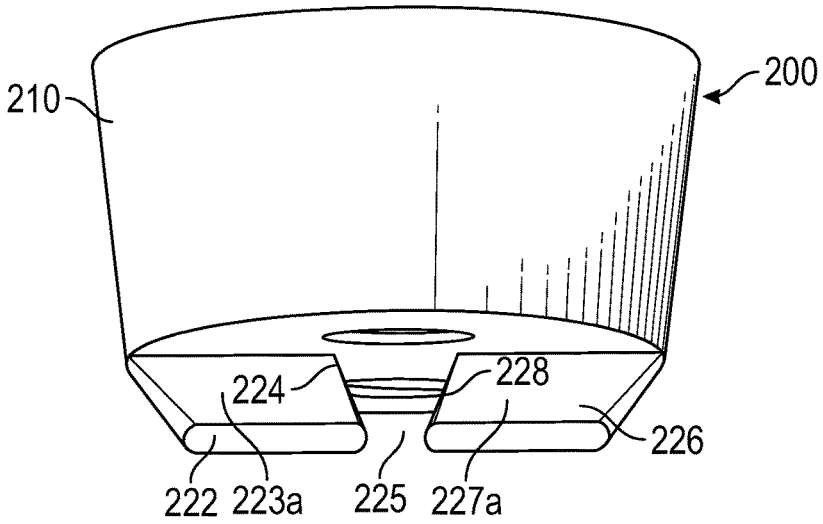
FIG. 19 is a side elevational view of the slidable weight shown in FIG. 18 without bolts.
Figure 20:
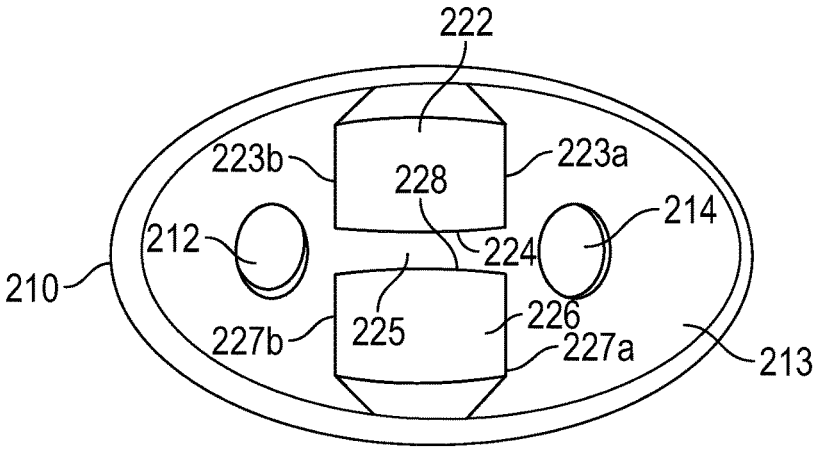
FIG. 20 is a bottom plan view of the slidable weight shown in FIG. 19.
Figure 21:
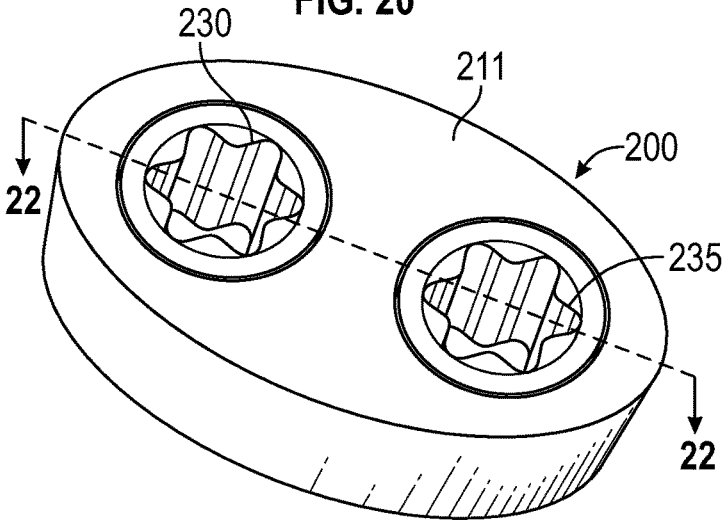
FIG. 21 is a top perspective view of the slidable weight shown in FIG. 19.
Figure 22:
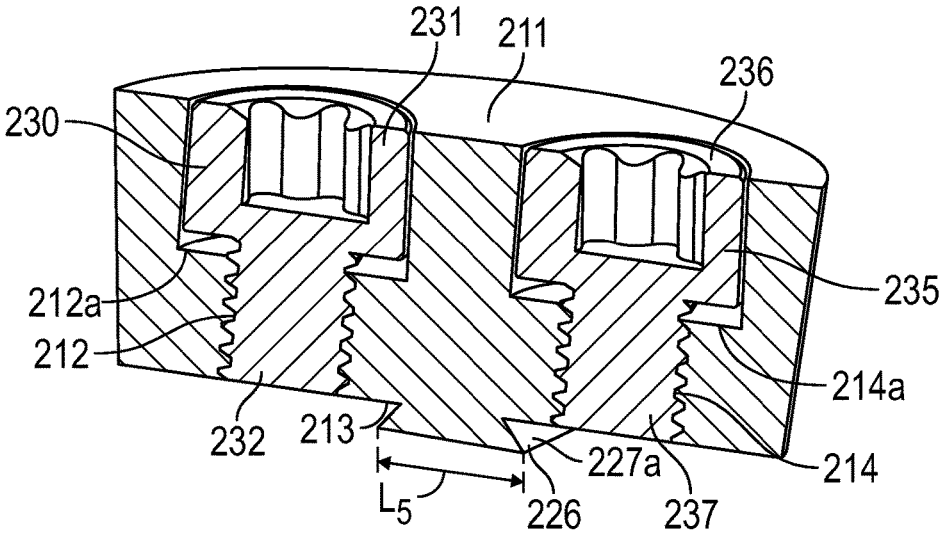
FIG. 22 is a cross-sectional view of the slidable weight shown in FIG. 21 along lines 22-22 with bolts engaged with the threaded bores.
Figure 23:
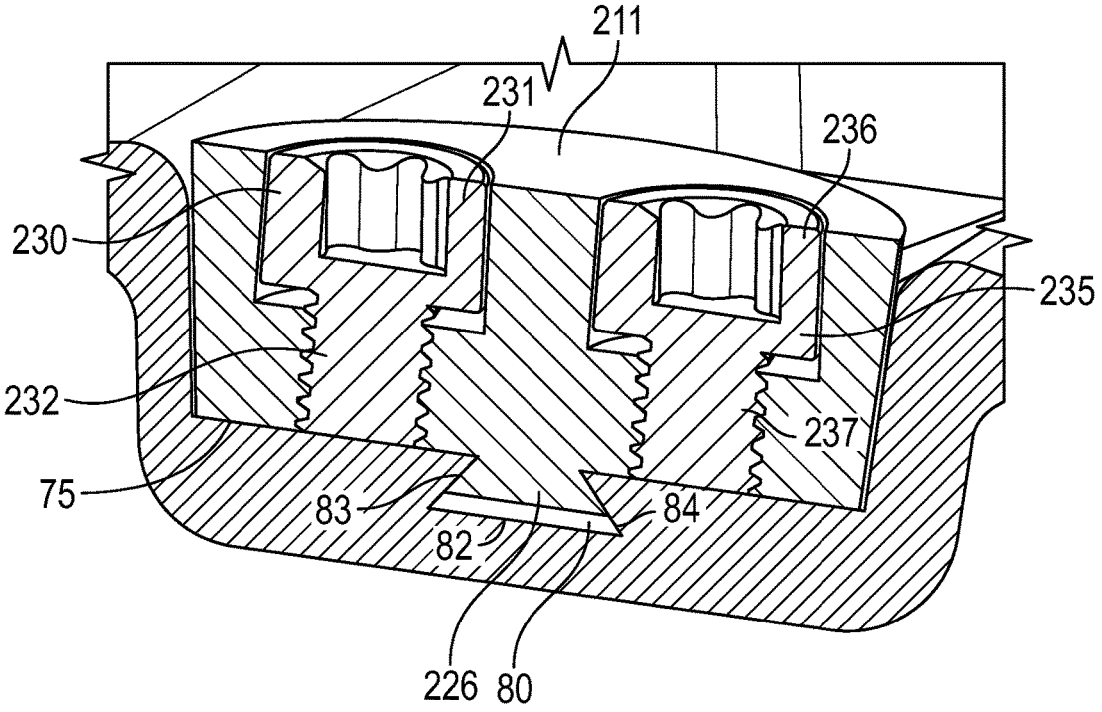
FIG. 23 is a cross-sectional view of the embodiment shown in FIG. 17 along lines 23-23.

As shown in FIG. 13, the preferred embodiment includes two weight assemblies 200, each with slightly different dimensions than that of the weight assembly 100 of the first embodiment. Each weight assembly 200 comprises a contoured, elliptical body portion 210 with an upper surface 211, a lower surface 213, first and second threaded through-bores 212, 214, a clamping portion 220, and two bolts 230, 235. The clamping portion 220 comprises a pair of tapered projections 222, 226, each of which has a length $L_5$ that increases as the tapered projections 222, 226 extend away from the lower surface 213, such that each tapered projection 222, 226 has an approximately triangular cross-sectional shape that matches the cross-sectional shape of the groove 80. A void 225 between the tapered projections 222, 226 is shaped to receive the rail 60 of the elongated channel 50, thus allowing the weight assembly 200 to move along, and be fixed to, the elongated channel 50 in the same manner as the slidable weight assembly 100 of the first embodiment. Like the first embodiment, the curvature of the tapered projections' 222, 226 inner surfaces 224, 228 allow the weight assembly 200 to move freely, as they have smaller radii than that of the rail's 60 radii.

Unlike the slidable weight assembly 100 of the first embodiment, however, when the weight assembly 200 of the preferred embodiment is disposed within the open space 65 at the junction 90 between the two elongated channels 50, 70, the weight assembly 200 can be moved into the second elongated channel 70 by sliding the tapered projections 222, 226 into the groove 80 of the second elongated channel 70. The weight assembly 200 does not need to be removed and indexed in order for it to be affixed to the second elongated channel 70, saving a user time during adjustment of the golf club head 10. The geometry of the groove 80 and the tapered projections 222, 226 prevents the weight assembly 200 from disengaging from the second elongated channel 70, and the weight can be removably affixed to any point within the second elongated channel 70 by tightening one or both of the bolts 230, 235 until the threaded extension portions 232, 237 make contact with the floor 75 and push the elliptical body portion 210 away from the floor 75, thus creating a clamping force between the inner sides 83, 84 of the groove 80 and the outer surfaces 223*a*, 223*b*, 227*a*, 227*b* of the tapered projections 222, 226.

The open space 65 at the junction 90 may be filled with a plug (not shown) to further ensure that none of the weight assemblies 200 becomes disengaged from the elongated channels 50, 70. The plug may have clamping features that snap onto one or both of the rail 60 segments 62, 64, and/or a feature that slides into a portion of the groove 80, and/or it may include a threaded bore that lines up with a threaded bore in the open space 65 to receive a bolt to secure it to the golf club head 10. The plug may also have any of the features of the stopper disclosed in U.S. patent application Ser. No. 14/174,068 or the weight screw or plug disclosed in U.S. patent application Ser. No. 14/163,946.

In each of the embodiments disclosed herein, there preferably is a clearance between the head portion 131, 136, 231, 236 of the bolts 130, 135, 230, 235 and a floor portion 112*a*, 114*a*, 212*a*, 214*a*, of the threaded through-bores 112, 114, 212, 214 so that the bolts 130, 135, 230, 235 can be screwed downwards such that their threaded extension portions 132, 137, 232, 237 can make contact with the rail 60 or the floor 75 of the elongated channels 50, 70, whichever is applicable. In any of the embodiments disclosed herein, the crown 30 may be affixed to the body 20 with an adhesive material. The crown 30 is formed from a light-weight material, preferably a non-metal material such as a composite, which may be selected from any of the composite materials disclosed in U.S. Pat. Nos. 8,460,123 and 9,033,822, the disclosure of each of which is hereby incorporated by reference in its entirety herein.

The rail 60 and plug may be formed as disclosed in U.S. patent application Ser. No. 14/174,068, the disclosure of which is hereby incorporated by reference in its entirety herein. Similarly, the elongated channels 50, 70 disclosed herein may have any of the configurations disclosed in U.S. Pat. No. 8,696,491, the disclosure of which is hereby incorporated by reference in its entirety herein, and the elongated channels 50 disclosed herein may be disposed anywhere on the golf club head 10, including the sole 40, crown 30, face 22, and ribbon portions, if applicable. Though the embodiment disclosed herein is shown in a driver, the inventive adjustable weighting configuration may also be used with other type of golf clubs, including fairway woods, irons, wedges, hybrids, and putters.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a face and a sole, the sole comprising a first channel comprising a first floor;

a crown;

at least one rail comprising an upper portion having a V-shaped cross-section, the at least one rail disposed within the first channel and extending from the first floor in a direction normal to the first floor; and a first weight assembly comprising;

at least one mechanical fastener comprising a head portion and a threaded extension portion; and a body portion comprising an upper surface, a lower surface, at least one threaded through bore extending from the upper surface to the lower surface, and a clamping portion comprising first and second tapered projections extending from the lower surface, wherein each of the first and second tapered projections increases in length as it extends away from the lower surface of the body portion, wherein a cross-section of a void between the first and second tapered projections is V-shaped, wherein the void is sized to receive the upper portion of the at least one rail, wherein the first and second tapered projections have a first plurality of surface radii, wherein the at least one rail has a second plurality of surface radii, wherein the radii of the first plurality of surface radii are smaller than the radii of the second plurality of surface radii, wherein the body portion receives at least the upper portion of the at least one rail within the clamping portion, wherein the threaded extension portion is sized to fit within the threaded through bore, and wherein the first weight assembly is reversibly affixed to the at least one rail with the mechanical fastener.

2. The golf club head of claim 1, wherein the threaded extension portion abuts an upper surface of the at least one rail when the at least one mechanical fastener is fully engaged with the threaded through bore.

3. A golf club head comprising:

a body comprising a face and a sole, the sole comprising a first channel comprising a first floor and a second channel comprising a second channel length and a second floor;

a crown;

at least one rail disposed within the first channel and extending from the first floor in a direction normal to the first floor; and a first weight assembly comprising;

at least one mechanical fastener comprising a head portion and a threaded extension portion; and a body portion comprising an upper surface, a lower surface, at least one threaded through bore extending from the upper surface to the lower surface, and a clamping portion extending from the lower surface, wherein the second floor comprises a groove, wherein the groove extends along the entire second channel length, wherein the groove is shaped to receive the clamping portion of the first weight, wherein the body portion receives at least an upper portion of the at least one rail within the clamping portion, wherein the threaded extension portion is sized to fit within the threaded through bore, and wherein the first weight assembly is reversibly affixed to the at least one rail with the mechanical fastener.

4. The golf club head of claim 3, wherein the clamping portion comprises first and second tapered projections, wherein each of the first and second tapered projections increases in length as it extends away from the lower surface of the body portion, wherein the groove comprises a groove floor and first and second groove sidewalls, and wherein the first and second groove sidewalls extend towards one another as they extend away from the groove floor.

5. The golf club head of claim 3, wherein the second channel intersects with the first channel.

6. The golf club head of claim 5, wherein the second channel extends in a direction normal to at least a portion of the first channel.

7. A golf club head comprising:

a body comprising a face and a sole, the sole comprising a first channel comprising a first floor;

a crown;

at least one rail disposed within the first channel and extending from the first floor in a direction normal to the first floor; and a first weight assembly comprising;

at least one mechanical fastener comprising a head portion and a threaded extension portion; and a body portion comprising an upper surface, a lower surface, at least one threaded through bore extending from the upper surface to the lower surface, and a clamping portion extending from the lower surface, wherein the body portion has contoured shape, wherein the at least one threaded through bore comprises a first threaded through bore and a second threaded through bore, wherein the at least one mechanical fastener comprises a first bolt and a second bolt, wherein the body portion receives at least an upper portion of the at least one rail within the clamping portion, wherein the threaded extension portion is sized to fit within the threaded through bore, and wherein the first weight assembly is reversibly affixed to the at least one rail with the mechanical fastener.

8. The golf club head of claim 7, wherein the body portion has an elliptical shape.

9. The golf club head of claim 7, wherein the first weight assembly has at least four points of contact on the at least one rail when the first and second bolts are fully engaged with the threaded through bore.

10. A golf club head comprising:

a body comprising a face and a sole, the sole comprising a first channel comprising a first floor;

a crown;

at least one rail disposed within the first channel and extending from the first floor in a direction normal to the first floor; and a first weight assembly comprising;

at least one mechanical fastener comprising a head portion and a threaded extension portion; and a body portion comprising an upper surface, a lower surface, at least one threaded through bore extending from the upper surface to the lower surface, and a clamping portion extending from the lower surface, wherein the body portion receives at least an upper portion of the at least one rail within the clamping portion, wherein the threaded extension portion is sized to fit within the threaded through bore, wherein the first weight assembly is reversibly affixed to the at least one rail with the mechanical fastener, wherein the at least one rail comprises a first rail and a second rail, wherein the clamping portion has a first length, wherein an open space is disposed between the first rail and the second rail, and wherein the open space has a second length that is greater than the first length.

11. The golf club head of claim 10, further comprising a second channel comprising a second floor, wherein the second floor comprises a groove, wherein the groove is shaped to receive the clamping portion of the first weight, wherein the clamping portion is inserted into the groove at a groove opening, wherein the second channel intersects with the first channel, and wherein the groove opening is disposed proximate the open space between the first and second rails.

12. The golf club head of claim 10, further comprising a plug, wherein the plug is sized to fit within the open space and prevent the first weight from disengaging from either of the first and second rails.

13. A wood-type golf club head comprising:

a face component;

a sole comprising a heel side, a toe side, a rear side, a first channel extending from the heel side to the toe side via the rear side, and a second channel extending from a location proximate the face to the rear side and intersecting the first channel at the rear side;

a crown;

a weight assembly comprising;

first and second bolts; and an elliptical body portion comprising an upper surface, a lower surface, first and second threaded through bores extending from the upper surface to the lower surface, and a clamping portion extending from the lower surface, wherein the first bolt is engaged with the first threaded through bore, wherein the second bolt is engaged with the second threaded through bore, wherein the clamping portion comprises first and second projections, wherein the clamping portion is disposed between the first and second threaded through bores, wherein the first channel comprises a first floor and a rail extending upwards from the first floor, wherein the second channel comprises second floor and a groove sized to receive the clamping portion disposed in the second floor, wherein a void between the first and second projections is sized to receive at least a portion of the rail, wherein when a portion of the rail is disposed within the void, tightening at least one of the first and second bolts reversibly fixes the weight assembly within the first channel, and wherein when the clamping portion is disposed within the groove, tightening at least one of the first and second bolts reversibly fixes the weight assembly within the second channel.

14. The wood-type golf club head of claim 13, wherein when the weight assembly is disposed within the first channel, the weight assembly has at least four points of contact with the rail when the first and second bolts are tightened within the first and second threaded through bores.

15. The wood-type golf club head of claim 13, wherein when the weight assembly is disposed within the second channel, the first and second bolts contact the second floor when the first and second bolts are tightened within the first and second threaded through bores.

16. The wood-type golf club head of claim 13, wherein the rail has cross-sectional shape selected from the group consisting of T-shaped, V-shaped, and Y-shaped.

17. The wood-type golf club head of claim 13, wherein the first and second projections comprise wall radii that are smaller than any wall radii on the rail.

* * * * *